US006129254A

United States Patent [19]

Yu

[11] Patent Number: 6,129,254

[45] Date of Patent: Oct. 10, 2000

[54] BACKPACK WITH FLEXIBLE FILE SYSTEM

[75] Inventor: Peter Yu, Los Angeles, Calif.

[73] Assignee: Travelers Club Luggage, Inc., Los Angeles, Calif.

[21] Appl. No.: 09/245,998

[22] Filed: Feb. 5, 1999

[51] Int. Cl.[7] ..... A45F 3/04; A45F 4/02; A45C 13/26

[52] U.S. Cl. ..... 224/575; 190/18 A; 190/110; 224/153; 224/652; 224/653; 224/681

[58] Field of Search ..... 224/650, 652, 224/653, 223, 681, 153, 575; 190/18 A, 900, 901, 902, 109, 110

[56] References Cited

U.S. PATENT DOCUMENTS

| | | | |
|---|---|---|---|
| D. 387,198 | 12/1997 | Lehmann et al. | 224/153 |
| 2,011,879 | 8/1935 | Stein | 190/109 |
| 2,053,630 | 9/1936 | Plotkin | 190/901 |
| 4,265,286 | 5/1981 | Rapoport | 190/900 |
| 5,447,261 | 9/1995 | Mitomi et al. | 190/18 A |
| 5,676,286 | 10/1997 | Song | 190/18 A |
| 5,984,154 | 11/1999 | Scicluna | 224/153 |

*Primary Examiner*—Stephen P. Garbe
*Attorney, Agent, or Firm*—David O'Reilly

[57] ABSTRACT

A backpack either conventional or of the rolling type having an integrated flexible filing system for storing books, folders, files, papers, and other paraphernalia. The flexible filing system is comprised of a plurality of semi-rigid dividers securely attached to a back wall or panel in the main compartment of the backpack. The dividers are attached to a flexible side wall to allow the system to expand or collapse as needed. Optional features include graduated dividers that are progressively shorter from rear to back to facilitate access to the compartments. An additional optional feature is to make the top edges of the dividers at an oblique angle to facilitate viewing of materials sorted or stored in the compartments formed by the expandable file system. The expandable file systems can also be permanently attached to the back panel of a backpack or could be removable by using a hook and loop fastener.

15 Claims, 6 Drawing Sheets

BACKPACK WITH FLEXIBLE FILE SYSTEM

BACKGROUND OF THE INVENTION

1. Field of the Invention

This invention relates to backpacks and more particular relates to a backpack having a flexible filing system that divides the main compartment of the interior into compartments for books, files, folders, papers, and the like.

2. Background Information

Backpacks are among the most popular means for students, both college and pre-college schools to carry articles to and from school. Often these items include books, papers, and files along with clothing and perhaps some food. Generally backpacks are constructed in a semi-rectangular shape with access to the interior by a long peripheral zipper that allows access to a simple large cavity or compartment in the interior. Items to be transported are usually just stuffed in the large interior compartment and the zipper drawn to close the backpack. Pockets may be provided for small items but generally the large interior compartment remains undivided and is not particularly convenient for keeping items in the compartment sorted or separated.

One such backpack is shown as described in U.S. Pat. No. 4,096,978 issued to Frank M. Noice on Jun. 27, 1978. This patent teaches the backpack described above with the large interior compartment, outside pockets and zipper closure. This patent solves the problem of loose loads in the interior compartment by having straps inside to tighten against the load.

U.S. Pat. No. 5,209,384 of Anderson issued May 11, 1993 makes an effort to divide the large interior compartment into pockets to hold specific tools. Actually the backpack is three backpacks in one with separate large interior compartments separated by fabric panels and accessible by a long peripheral zipper. Each separate section has fabric pockets formed on the fabric panels in various shapes to hold various tools. Long narrow pockets are formed to hold long narrow tools such as screwdrivers, etc. Larger elastic topped pockets are formed for holding larger tools such as pliers, wrenches, etc.

A portable desk that can be carried like a backpack is shown and described in U.S. Pat. No. 5,680,973. A front side wall of the carrier has a rigid surface that can be used as a desk. The front side wall and rigid surface is closed by a zipper that when open reveals a large main compartment and a lateral and slide panels on the inside of the front panel.

Other U.S. patents that disclose backpacks or similar devices are U.S. Pat. No. 4,687,036; U.S. Pat. No. 5,743,447, and U.S. Pat. No. 5,706,992. The '036 patent discloses a handbag having dividers to form pockets which can be carried like a backpack but is really nothing more than a large purse. The '447 patent describes a rolling variable capacity backpack having a collapsible section which can be expanded to increase its capacity. It is intended as a substitute for school lockers. The '992 patent discloses a backpack for carrying a laptop computer. It has a large central compartment closed with a zipper and exterior pockets.

None of these patents teaches or suggests a flexible divider system to keep articles or items carried in the backpack separated or sorted. Each teaches the conventional backpack with a large central compartment closed by a zipper and pockets for various items on the outside. It would be advantageous if a flexible divider system could be provided for the large central compartment of a backpack that allows articles or items carried in the backpack to be separated or sorted.

It is therefore one object of the present invention to provide a backpack with a flexible divider system to divide a portion of the large main compartment for storing books, files, and papers.

Yet another object of the present invention is to add a flexible file system to the main compartment of a backpack.

Still another object of the present invention is to add a plurality of rigid dividers to the main compartment that are expandable.

Yet another object of the present invention is to provide a series of rigid dividers attached to the back panel of a backpack that are configured to facilitate access.

Still another object of the present invention is to attach a series of rigid dividers to the back panel of a backpack that are progressively shorter from the rear towards the front to facilitate access to the compartments formed by the dividers.

Yet another object is to provide an expandable, flexible file system to the main compartment of a backpack that detachable.

BRIEF DESCRIPTION OF THE INVENTION

The purpose of the present invention is to add a novel flexible filing system comprised of rigid dividers expandably attached to the back panel of the backpack for holding books, files, folders, papers and the like.

The backpack is a flexible bag having flexible front and sides and a semi-rigid back panel. Straps are provided for carrying the backpack on the shoulders of a user. Generally pockets may be formed on flexible exterior services by material attached to the surface of the flexible bag having zipper closures.

The flexible bag is provided with a long peripheral zipper around three sides to access a large compartment in the interior. In some cases, material may be sewn to interior surfaces to form small pockets for holding small items.

The present invention provides a plurality of semi-rigid dividers attached to the main interior compartment on the back panel. The semi-rigid dividers are attached by flexible fabric side panels to form an expandable and collapsible filing system in the interior of the backpack. The semi-rigid panels form elongate expandable compartments for receiving folders, files, papers, books, and the like. The dividers are attached to the rear panel by the flexible expanding material and collapse to lay flat against the back panel when not in use. Each semi-rigid divider is secured to the adjacent divider by flexible expandable side panels. The dividers and side panels preferably extend only part way toward the bottom interior of the backpack to form open ended compartments. Optionally the flexible expandable side panels and dividers could extend to the bottom of the interior compartment to form compartments only open at the top if desired.

In an optional but preferred embodiment of the invention, each semi-rigid divider has a different height to facilitate access to the compartments. The rearmost semi-rigid divider would be taller and the adjacent dividers would become progressively shorter to facilitate ease of use. This would allow the user to easily see items in each compartment more clearly.

Another option is to have the upper most edge of each divider formed at an oblique angle so that books, files, folders, and papers would be partially visible so the user could quickly and easily determine what items are in each compartment.

Still another option is to attach the flexible filing system formed by a series of dividers by a hook and loop (VELCRO) connector so that it may be removed if desired. While the flexible filing system is collapsible, it does take up some space in the interior of the backpack. If one or two large items are all that are being carried in the main interior compartment of the backpack the user would have the option of simply removing the flexible file system.

The flexible filing system comprised of the dividers attached to the back panel of the backpack can be in the usual soft-sided backpacks but also is equally applicable to rolling backpacks. Rolling backpacks are comprised of a conventional backpack having a semi-rigid back panel and an extended semi-rigid compartment below the main compartment of the backpack. Wheels are attached to the semi-rigid compartment below the main compartment and a telescoping handle attached to the rear of the backpack. Shoulder straps are also attached to the rear of the backpack so that it can be carried on the shoulders like a conventional backpack with the handle retracted or the handle can be extended rolling the backpack on the wheels.

The above and other novel features of the invention will be more fully understood from the following detailed description and the accompanying drawings, in which:

DETAILED DESCRIPTION OF THE INVENTION

Figure 2:
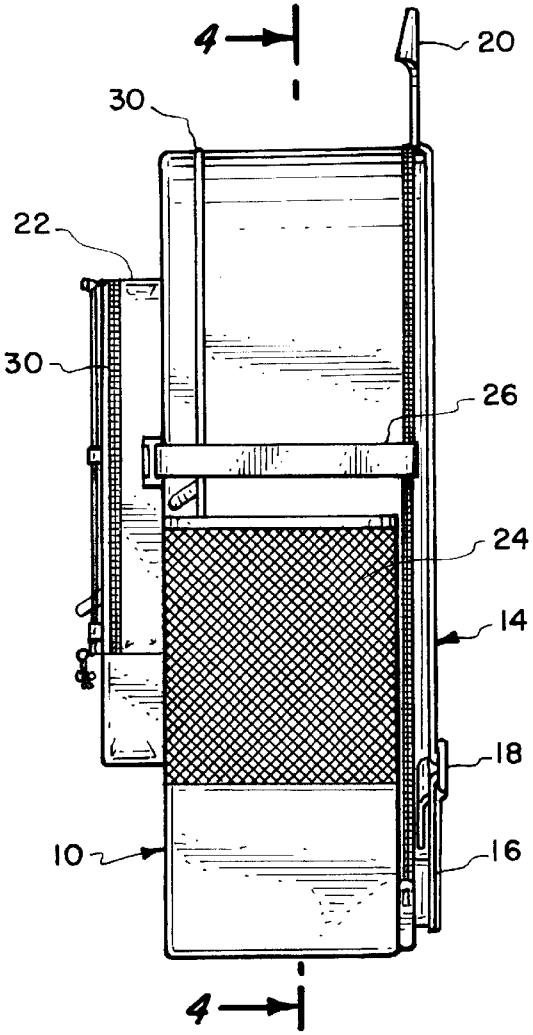
FIG. 2 is a side view of the backpack of FIG. 1.
Figure 1:
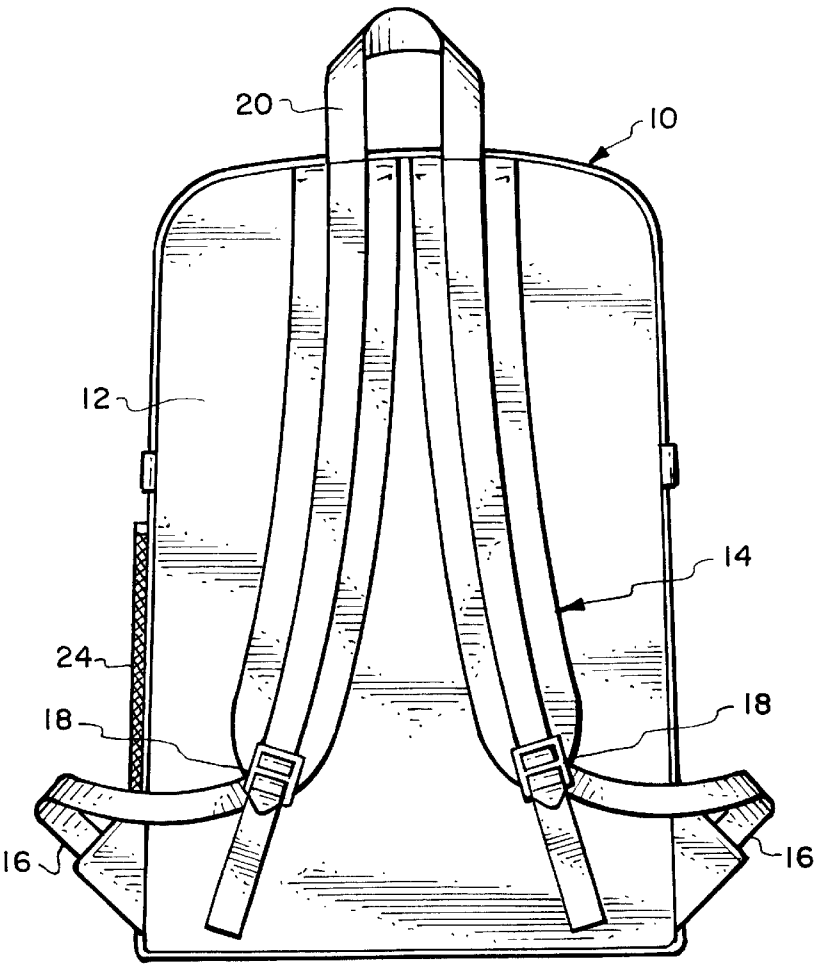
FIG. 1 is a rear view of the backpack showing the shoulder straps and a carrying strap.

A conventional backpack 10 is illustrated in FIG. 1. Conventional backpack 10 comprised of a semi-rigid or stiff back panel 12 usually comprised of some type of stiff material such as cardboard or foam covered by a fabric. Shoulder straps 14 are provided for carrying the backpack on the shoulders of the wearer. Adjustable straps 16 and buckles 18 allow shoulder straps 14 to be adjusted to the wearer. A carrying strap 20 is attached to backpack 10 as an extension of shoulder strap 14 to allow the backpack to be easily carried.

Figure 3:
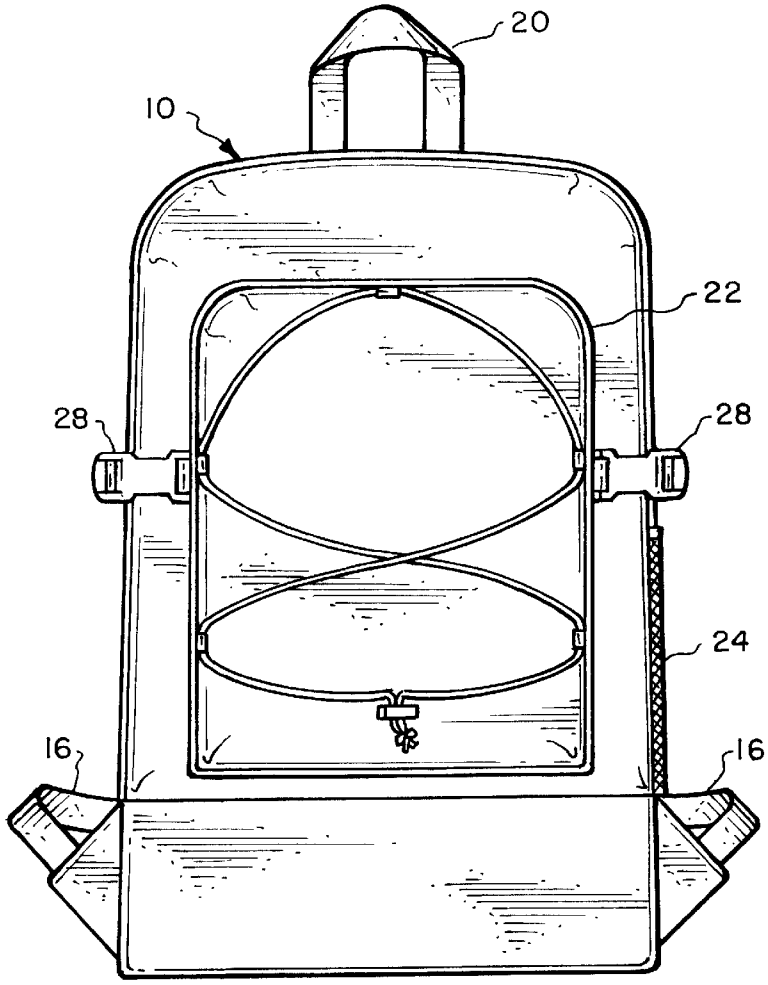
FIG. 3 is a front view of the backpack.

Backpack 10 is similar to conventional backpacks and has a pocket 22 on the front and an expandable pocket formed by netting 24 along a side. Such pockets attached to the exterior of backpack are conventional. Straps 26 secured by snap locks 28 (FIG. 3) on either side of backpack 10 allow the backpack to be tightened down against items stored in the interior. Access to backpack 10 is provided by an elongate zipper 30 wrapping around three sides of backpack 10.

Figure 4:
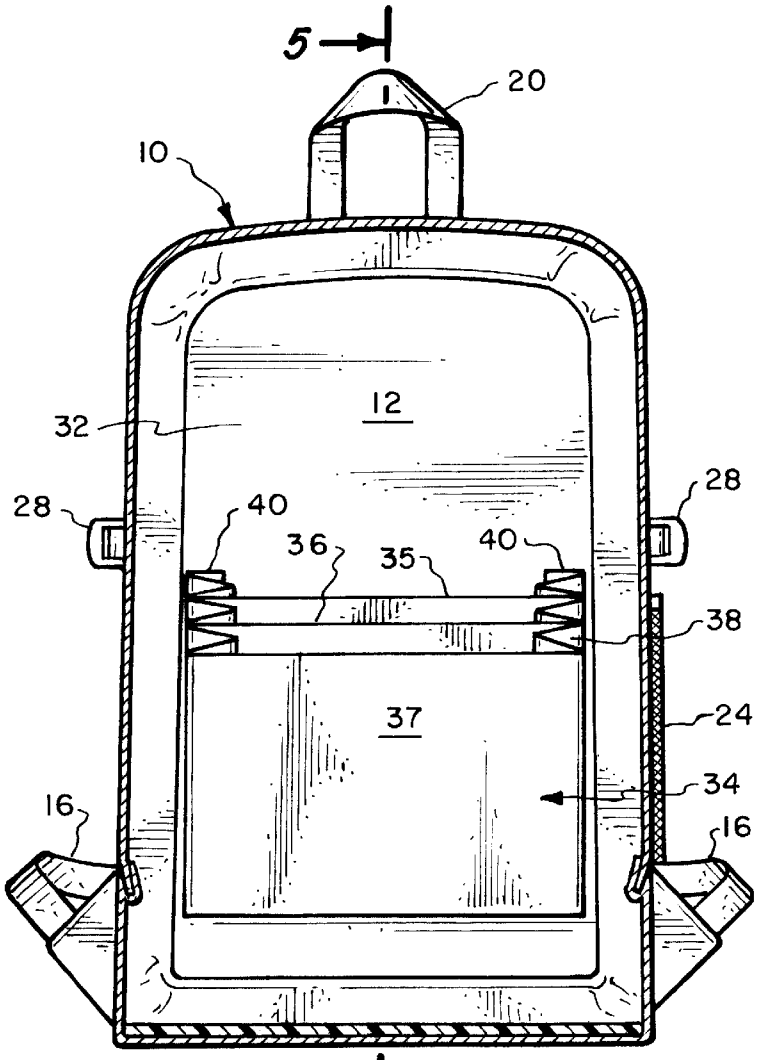
FIG. 4 is a sectional view taken at 4—4 of FIG. 2 illustrating the dividers forming the flexible filing system in the interior compartment of the backpack.

Backpack 10 has the usual large main interior compartment 32 illustrated in the sectional view of FIG. 4. Generally this large main compartment is one large empty compartment. Occasionally a backpack may have pockets attached to surfaces of large main compartment 32.

These backpacks are very popular with school children therefore would be advantageous to provide compartments for carrying school paraphernalia. Thus, a flexible file system 34 is incorporated into large interior compartment 32 comprised of semi-rigid dividers 35, 36, and 37 attached to flexible fabric material 38 which is securely attached by stitching 40 to back panel 12 of backpack 10. Flexible file system 34 therefore provides three compartments, 41 through 43 illustrated in FIGS. 5 through 7.

Figures 5, 6, 7:
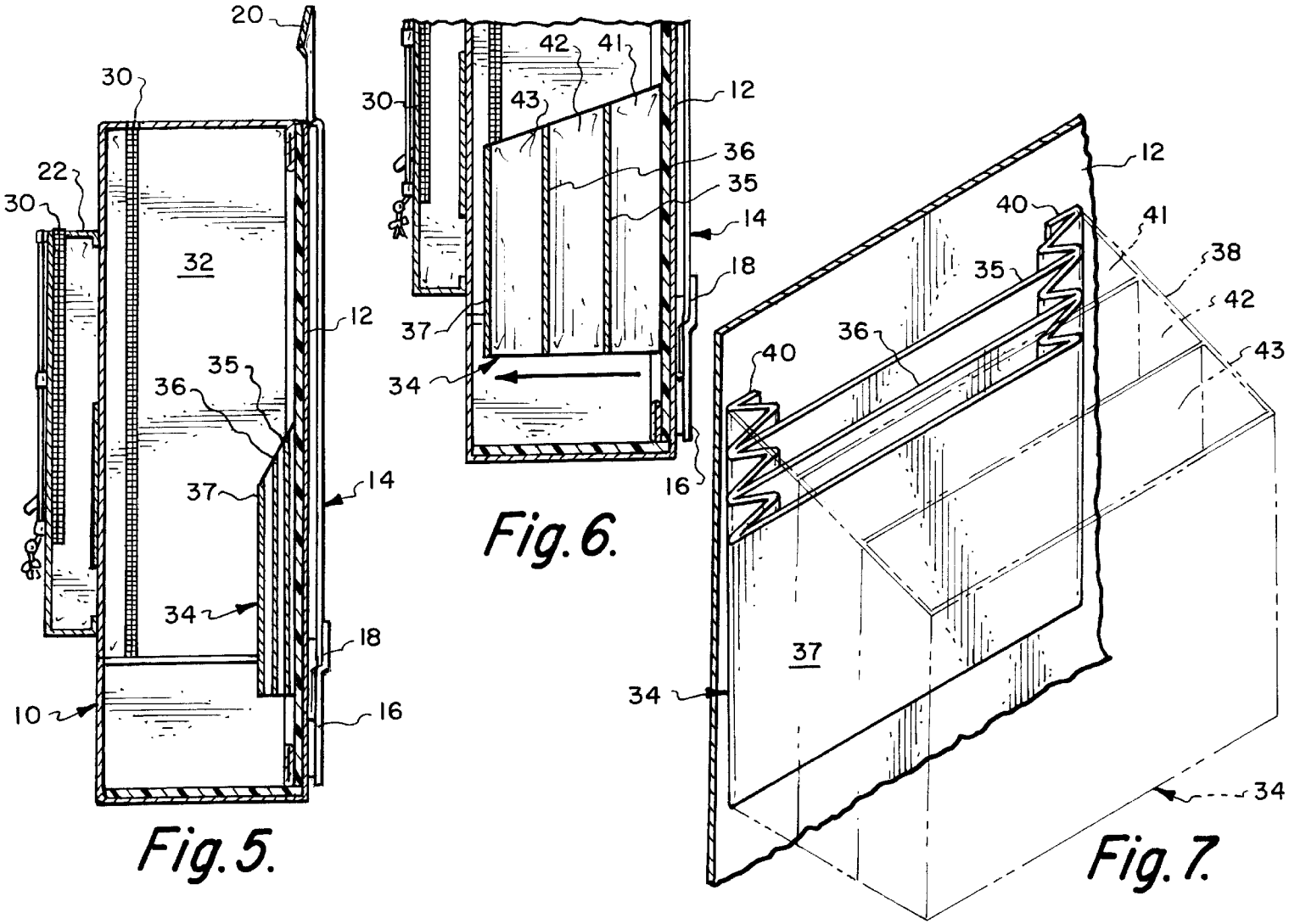
FIG. 5 is a sectional side view taken at 5—5 of FIG. 4 illustrating the flexible filing system in a collapsed position.
FIG. 6 is a partial sectional view similar to FIG. 5 illustrating a flexible filing system expanded.
FIG. 7 is a partial sectional view illustrating use of the flexible filing system attached to the back panel of the backpack.
Figure 9:
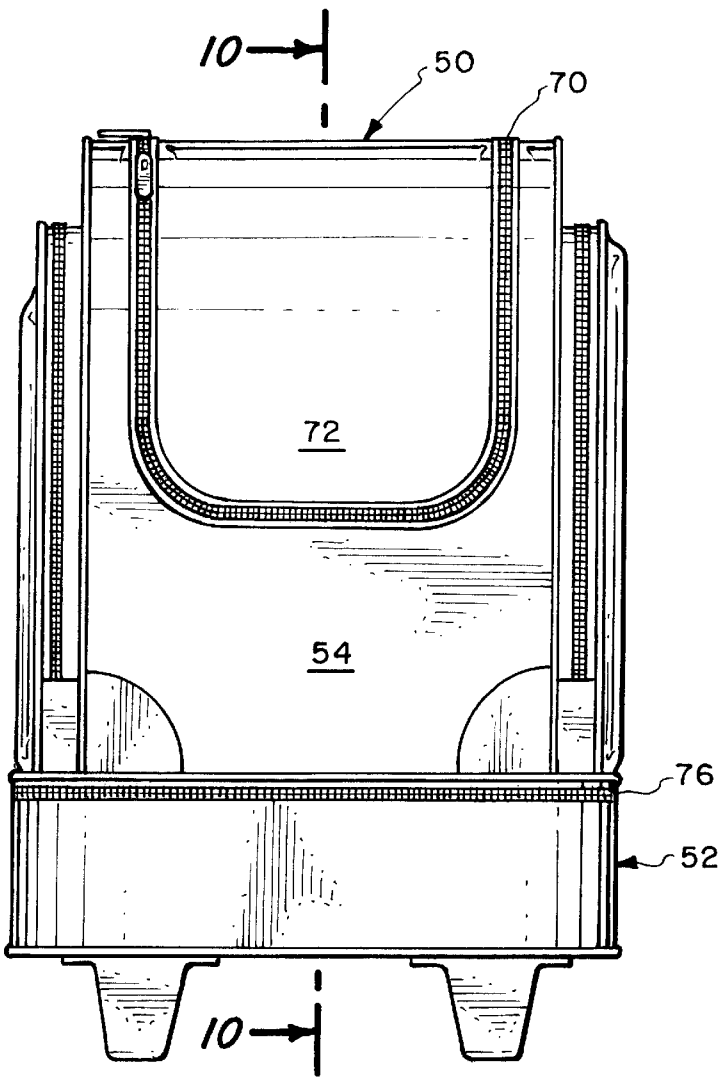
FIG. 9 is a front view of a rolling backpack.
Figure 8:
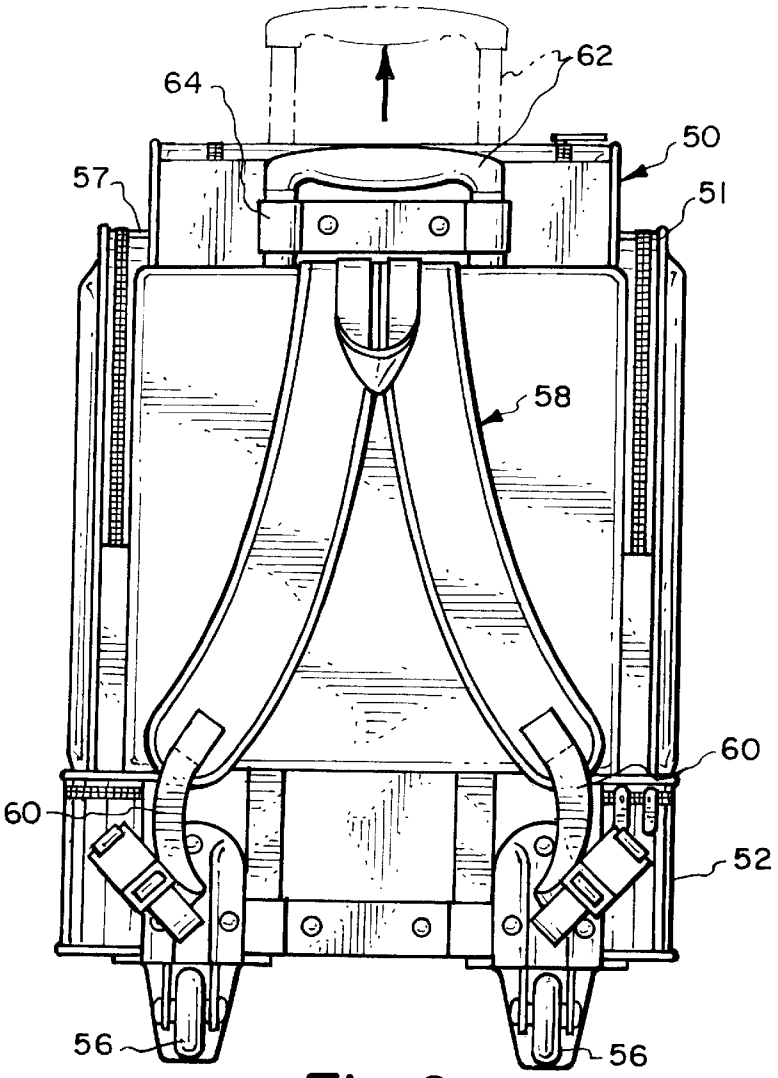
FIG. 8 is a rear view of a rolling backpack.

Flexible file system 34 is shown collapsed against back panel 12 when not in use. Flexible filing system 34 can be completely expanded as shown in FIGS. 6 and 7 for storage of books, folders, files, papers, and other paraphernalia. Simply inserting any of these items in one of the compartments 41 through 43 formed by stiff or semi-rigid dividers 35 through 37 expands that respective compartment. Flexible filing system 34 can be fully expanded by pulling forward on front semi-rigid divider 37 to expand flexible sides 38 forming compartments 41 through 43. The flexible expandable filing system 34 provides an innovation in convenience and organization allowing students to store and separate school materials from other paraphernalia carried in the backpack. The flexible filing system 34 provides an integrated multi-compartment expandable system for holding folders, files, books, papers, or the like. When not in use the flexible file system 34 lies flat against back panel 12 as illustrated in FIG. 5.

In an optional but preferred feature of the invention provided 35 through 37 forming compartments 41 through 43 are progressively shorter from the rear to the front to facilitate access to the compartments. Thus, semi-rigid divider 37 will be shorter than semi-rigid divider 36 which in turn will be shorter than semi-rigid divider 35. This facilitates access to any one f the compartments formed by compartments 41 through 43 formed by dividers 35 through 37.

In another embodiment of the invention the flexible file system can be applied to the rolling backpack illustrated in FIGS. 8 through 12. Rolling backpack 50 is similar in construction to conventional backpacks except that it includes a semi-rigid extension 52 to the flexible fabric top 54 for attaching wheels 56. Rolling backpack 50 has the usual shoulder straps 58 where adjustable straps 60 as before. However, to use rolling backpack 50 as either a backpack or as a rolling backpack, telescoping handle 62 attached by bracket 64 to the back panel 66 (FIG. 10) is provided. With telescoping handle extended rolling backpack 50 can be pulled along on wheels 56. This is particularly helpful when rolling backpack is filled with a load too heavy to carry.

Figure 11:
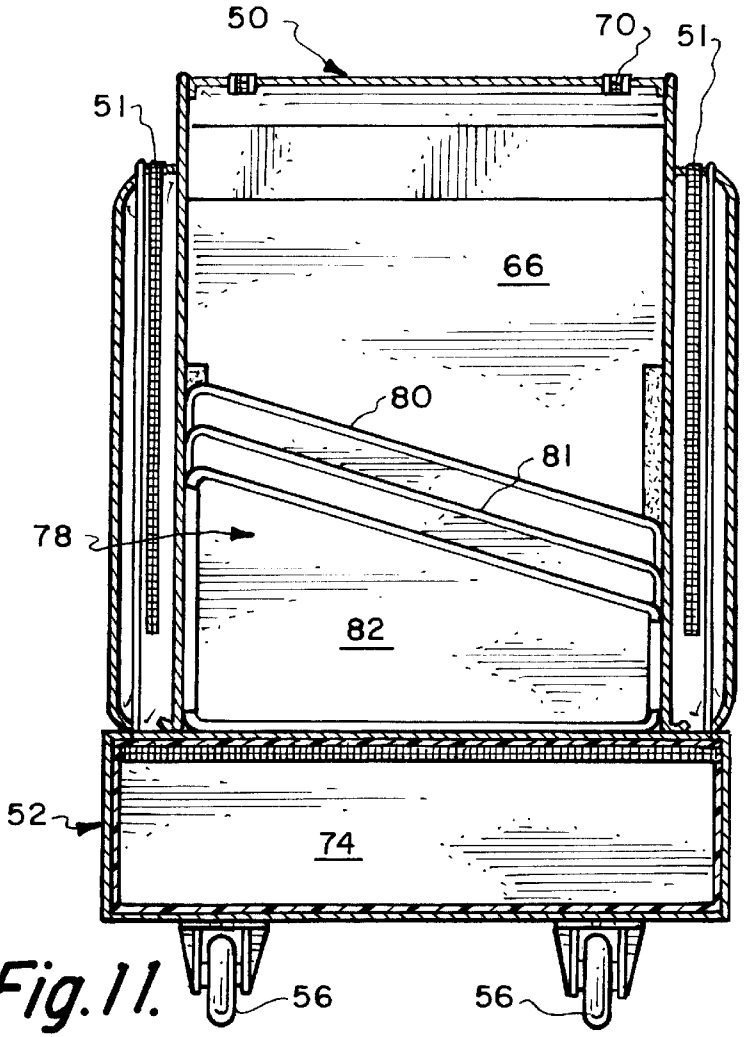
FIG. 11 is a sectional view of the rolling backpack taken at 11—11 of FIG. 10 illustrating an optional construction of the flexible filing system.
Figure 10:
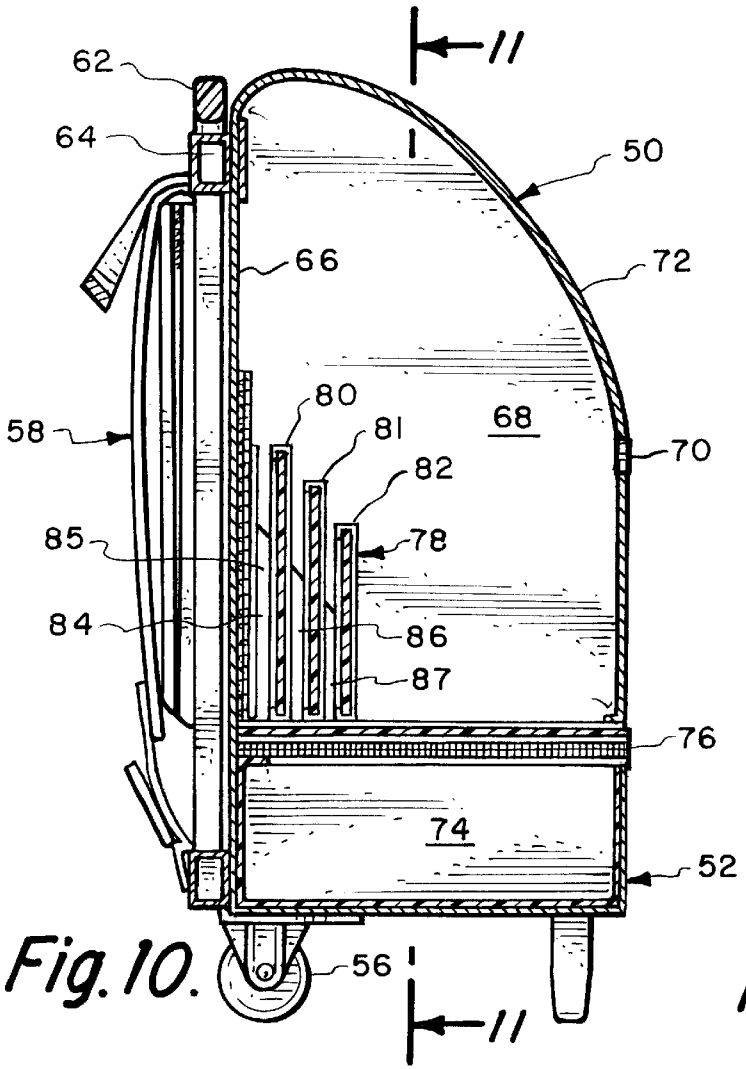
FIG. 10 is a sectional view of the rolling backpack taken at 10—10 of FIG. 9.

Flexible file system 78 may be attached by sewing fabric 84 to back panel 66 as in the embodiment of FIGS. 1 through 7. An additional optional feature in addition to making respective dividers progressively shorter is to form dividers 80 to 82 at an oblique angle as illustrated in FIG. 11. This would further facilitate use of compartments 85 through 87 formed by dividers 80 through 82. Folders, books, papers, etc. in compartment 85 through 87 formed by dividers 80 through 82 would be more visible and accessible by a user. For example, on the lower end of the oblique angle of dividers 80 through 82, a portion of a paper or folder may be seen allowing the user to quickly identify what items are in which of the compartments 85 through 87. As before backpack 50 has pockets 51 attached to both sides on the exterior surface.

Figure 12:
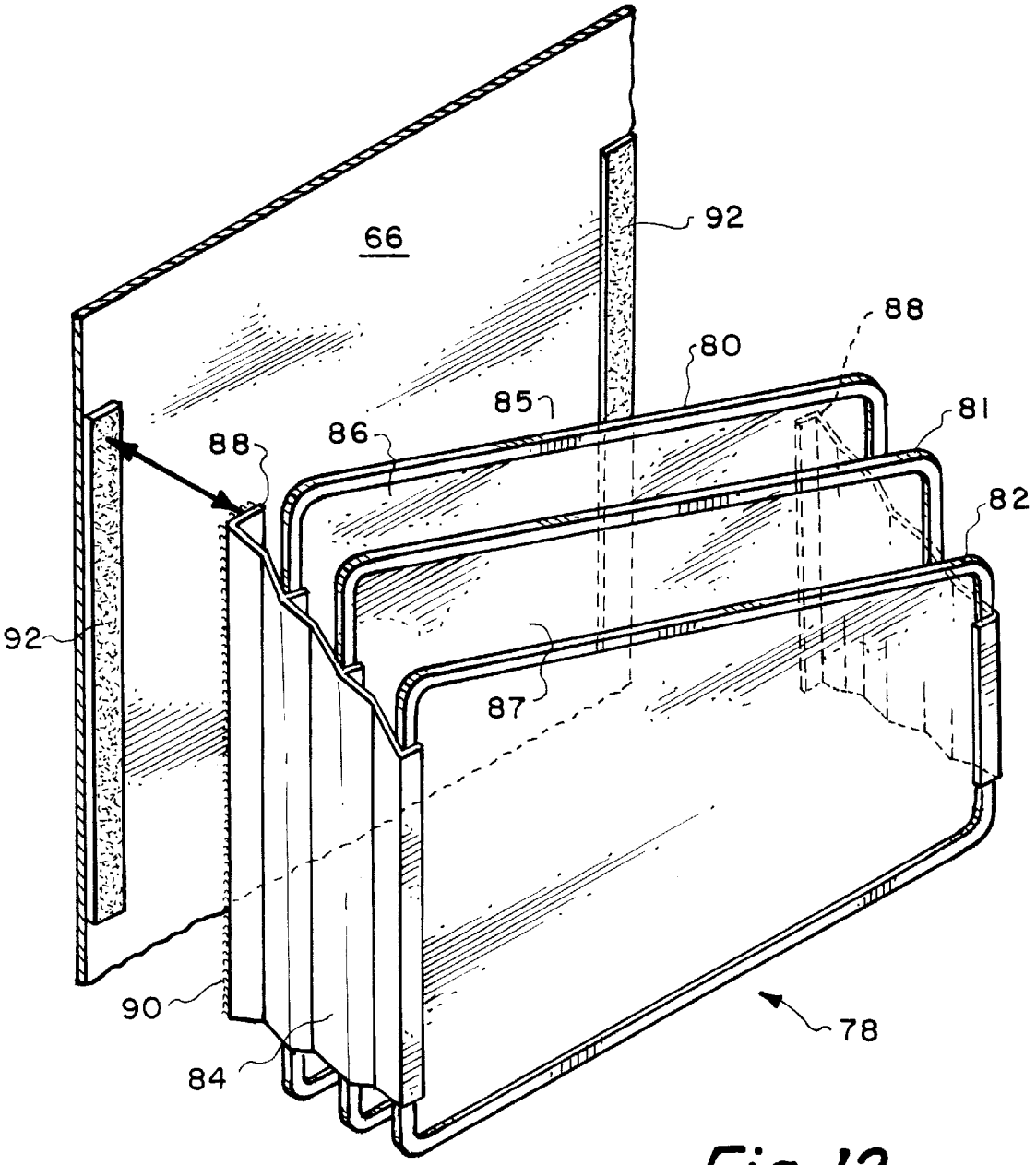
FIG. 12 is a partial sectional view of a backpack illustrating a detachable flexible filing system.

The operation as well as an additional optional feature of the invention is illustrated in FIG. 12. Flexible fabric or webbing is attached to each semi-rigid panels 80 through 82 to form flexible filing systems 78. Flexible filing system 78 expands automatically as folders, books, or other materials are inserted in compartments 85 through 87 as shown in FIG. 12. Flexible fabric 84 stretches to expand each respective compartment. The oblique angle at the top of each divider 80 through 82 allows items such as folders, books, and papers to be more easily viewed.

While it is preferable to securely attach the flexible filing system in either embodiment to the back panel of the backpack, it may be desirable in some instances to have it removable. To make flexible filing system 78 removable it can be attached to back panel 66 with hook and loop material known by the trademark VELCRO. To perform this function, hook material 90 would be attached to stiff ends 88 of flexible fabric material 84 with loop material 92 being securely fastened to back panel 66. If the user of backpack 50 wanted additional space in interior compartment 68, the flexible filing system 78 could be easily be removed by detaching hook material 90 from loop material 92. Since flexible filing system 78 folds flat against back panel 66 when not in use, it normally would not need to be removed.

Rolling backpack 50 has a large main compartment 68 with access provided by long zipper 70 opening flap 72. An additional storage compartment 74 is formed in semi-rigid rectangular section 52 below main compartment 68. Access to the bottom compartment 74 is provided by elongate zipper 76 wrapping around three sides of backpack 50.

Thus there has been disclosed a unique, innovative flexible filing system incorporated in either conventional backpacks or rolling backpacks. In one embodiment, the flexible filing system is comprised of a plurality of semi-rigid dividers securely attached to the back panel of the backpack by a flexible material allowing the system to expand or collapse as needed. The system provides an integrated multi-compartment system with dividers graduated to be progressively shorter from rear to the front to allow sorting and storing of documents, books, etc. and facilitate handling. The semi-rigid dividers will lay flat against the back wall of the bag when not in use. Optional embodiments include different height dividers having obliquely angled top edges to facilitate use and to facilitate viewing of material in compartments formed by the dividers and a detachable flexible filing system.

This invention is not to be limited by the embodiment shown in the drawings and described in the description which is given by way of example and not of limitation, but only in accordance with the scope of the appended claims.

What is claimed is:

1. In a backpack formed of a flexible fabric material having a semi-rigid back panel, shoulder straps for carrying the backpack and an elongate zipper providing access to a main interior storage compartment the improvement comprising;

a plurality of semi-rigid dividers;

a flexible fabric securing said plurality of dividers at the sides to form a series of expandable compartments;

securing means securing said plurality of dividers to said back panel of said backpack;

whereby said plurality of dividers form a flexible, expandable filing system in said backpack.

2. The backpack according to claim 1 in which said securing means comprises securely fastening each side of said flexible fabric to said back panel.

3. The backpack according to claim 1 in which said plurality of dividers is three dividers forming a series of three compartments at the back of said backpack.

4. The backpack according to claim 3 in which said dividers have has different heights to facilitate access to said compartments.

5. The backpack according to claim 4 in which said dividers are progressively shorter from back to front.

6. The backpack according to claim 5 in which each divider has an obliquely angled top edge to facilitate viewing materials stored in said compartments.

7. The backpack according to claim 1 in which said flexible filing system is detachable for removing it from said backpack.

8. The backpack according to claim 7 in which said securing means is hook and loop material allowing said flexible filing system to be detachable.

9. The backpack according to claim 1 in which said backpack is a rolling backpack.

10. The backpack according to claim 1 in which said backpack has a semi-rigid compartment attached to the bottom; wheels attached to bottom surface of said semi-rigid compartment and a telescoping handle attached to the exterior of said back panel whereby said backpack may be used as a rolling backpack.

11. The backpack according to claim 10 in which said securing means comprises securely fastening each side of said flexible fabric to said back panel.

12. The backpack according to claim 11 in which said plurality of dividers is three dividers forming a series of three compartments at the back of said backpack.

13. The backpack according to claim 12 in which said dividers have has different heights to facilitate access to said compartments.

14. The backpack according to claim 13 in which said dividers are progressively shorter from back to front.

15. The backpack according to claim 14 in which each divider has an obliquely angled top edge to facilitate viewing materials stored in said compartments.

* * * * *